US007989405B2

(12) United States Patent
Nettleship et al.

(10) Patent No.: US 7,989,405 B2
(45) Date of Patent: Aug. 2, 2011

(54) PREVENTION OF MICROBIAL GROWTH IN METAL WORKING FLUIDS

(75) Inventors: Christopher John Nettleship, Leeds (GB); Stephen David Chapman, Leeds (GB)

(73) Assignee: Illinois Tool Works Inc., Glenview, IL (US)

( * ) Notice: Subject to any disclaimer, the term of this patent is extended or adjusted under 35 U.S.C. 154(b) by 1825 days.

(21) Appl. No.: 10/496,828

(22) PCT Filed: Nov. 26, 2002

(86) PCT No.: PCT/GB02/05321

§ 371 (c)(1), (2), (4) Date: Nov. 5, 2004

(87) PCT Pub. No.: WO03/048283

PCT Pub. Date: Jun. 12, 2003

(65) Prior Publication Data

US 2005/0059559 A1 Mar. 17, 2005

(30) Foreign Application Priority Data

Nov. 28, 2001 (GB) ..... 0128502.2
Jul. 3, 2002 (GB) ..... 0215454.0

(51) Int. Cl.
*C10M 133/48* (2006.01)
*C10M 141/06* (2006.01)

(52) U.S. Cl. ..... 508/270; 508/591; 72/42

(58) Field of Classification Search ..... 508/257, 508/258, 277, 278, 587, 270
See application file for complete search history.

(56) References Cited

U.S. PATENT DOCUMENTS

| | | | | | |
|---|---|---|---|---|---|
| 3,517,022 | A | * | 6/1970 | Miller et al. | 548/209 |
| 3,915,970 | A | | 10/1975 | Limaye et al. | |
| 4,159,253 | A | * | 6/1979 | Grier et al. | 508/257 |
| 4,277,353 | A | | 7/1981 | Deen et al. | |
| 4,414,121 | A | | 11/1983 | Aiello | |
| 4,425,248 | A | | 1/1984 | Piotrowski et al. | |
| 4,666,616 | A | * | 5/1987 | Rossmoore | 508/270 |
| 4,707,282 | A | * | 11/1987 | Rossmoore | 508/257 |
| 4,787,995 | A | * | 11/1988 | Nichols et al. | 508/451 |
| 4,946,612 | A | | 8/1990 | Kanamori et al. | |
| 4,968,323 | A | | 11/1990 | Blackburn et al. | |
| 5,162,354 | A | * | 11/1992 | Fernando Del Corral et al. | 514/376 |
| 5,508,417 | A | | 4/1996 | Osei-Gyimah et al. | |
| 5,534,624 | A | * | 7/1996 | Lesmann et al. | 544/196 |
| 5,716,917 | A | * | 2/1998 | Williams et al. | 508/547 |
| 5,798,322 | A | * | 8/1998 | Brannen et al. | 508/442 |
| 6,310,013 | B1 | * | 10/2001 | Lokkesmoe et al. | 508/502 |
| 6,861,395 | B2 | * | 3/2005 | Eastwood et al. | 508/275 |
| 7,320,758 | B2 | * | 1/2008 | Messier et al. | 210/668 |

FOREIGN PATENT DOCUMENTS

| | | | | |
|---|---|---|---|---|
| DE | 35 08 946 | A | | 9/1986 |
| GB | 1 505 069 | A | | 3/1978 |
| GB | 2230190 | A | * | 10/1990 |
| WO | WO 99/65315 | | * | 12/1999 |
| WO | 01 30946 | A | | 5/2001 |
| WO | 01 92444 | A | | 12/2001 |

* cited by examiner

*Primary Examiner* — Ellen M McAvoy
(74) *Attorney, Agent, or Firm* — Lowe Hauptman Ham & Berner LLP

(57) ABSTRACT

A method of preventing microbial growth in oil-water metalworking fluid in a machine wherein lubricating oil or hydraulic or tapping fluid can contaminate the metalworking fluid, comprises adding a partitionable anti-microbial agent, active against micro-organisms present in the metalworking fluid, to the lubricating oil or hydraulic or tapping fluid whereby an effective quantity of anti-microbial agent can migrate into the metalworking fluid to reduce micro-organism activity.

A machine tool lubricating oil or hydraulic or tapping fluid composition comprises in a mineral oil or other lubricant base and an oil-water partitionable anti-microbial, active against micro-organisms present in oil-water metalworking fluids.

1 Claim, No Drawings

PREVENTION OF MICROBIAL GROWTH IN METAL WORKING FLUIDS

FIELD OF THE INVENTION

This invention relates to the prevention of microbial growth in metalworking fluids in a machine, wherein lubricating oil or hydraulic or tapping fluids can contaminate the metalworking fluid and to machine-tool lubricants, hydraulic or tapping fluids and the like incorporating anti-microbial agents, and specifically relates to a method of introducing antimicrobial agents into metalworking fluids.

BACKGROUND TO THE INVENTION

In many mechanical environments, there will be present both oil based and water based compounds. Many machines use hydraulic power incorporating a high pressure hydraulic fluid, an oil, in a sealed environment. However, seals age and leakage of hydraulic fluid can occur to contaminate metalworking fluid.

Mechanical processes often need a lubricating compound to prevent friction between moving parts. An example of such a system is industrial metal-working machine tools wherein the work piece and tooling are positioned and moved on flat bearings generally referred to as slideways. These surfaces require a lubricant—the slideway lubricant—to reduce the metal/metal contact therefore eliminating friction and 'stick-slip' motion, and prevent wear on the slideways. This is essential to maintain the potentially very expensive machine tool in good condition and to ensure machining accuracy. As most machining processes also utilise a flood applied, water-oil emulsion based metalworking fluid to cool and lubricate the working zone the slideway lubricant is constantly washed off the surfaces of the slides. To combat this most machine tools automatically dispense oil onto the slides on a continuous or metered basis. Given the very low cost of the slideway lubricant this total loss system is the most cost effective method of ensuring that the performance of the machine is not compromised. The lost lubricant, tramp oil, is washed with the metalworking fluid into a sump, from which the metalworking fluid is recycled.

Whilst such methods ensure that the machine stays in good condition it has the opposite effect on the metalworking fluids. Being oil-water emulsions, metalworking fluids provide an ideal environment for microbial growth. Although great efforts are made when formulating metalworking fluids to exclude obvious sources of nutrients and to ensure that the fluids are as resistant as possible to microbial growth this is largely negated if contaminated by the slideway lubricant. Since slideway lubricants are generally based on refined mineral oils and contain elements such as sulphur and phosphorus (as anti-wear and anti-corrosion agents), these provide ideal nutrients for micro-organisms. It is accepted throughout the metalworking industry that one of the main causes of failure for metalworking fluids is microbial growth promoted by excessive contamination with slideway lubricants. In systems with low agitation the slideway oil can separate from the emulsion, sealing it from the air. In such anaerobic conditions microbial growth in fluids produces by-products of respiration, such as Hydrogen Sulphide which causes an unpleasant odour and makes the system unpleasant to work with.

Hand applied tapping fluids, may be used for tapping, reaming and drilling operations, and when used on machine tools with water mix, flood applied cutting fluids can also contaminate the cutting fluid.

Several attempts have been made to overcome this problem, which include:

i) Use of synthetic, biologically-hard base fluids instead of mineral oil as the base for slideway lubricants. While this may reduce the overall level of nutrient for the microbes the key sulphur and phosphorus agent agents are still present. Synthetic base fluids are also prohibitively expensive for 'total loss' systems.

ii) Use of the metalworking fluid concentrate as the slideway lubricant. Although this overcomes the contamination problem the primary function as a slideway lubricant is compromised. The ease with which these products can be washed away can leave slideways 'dry' resulting in high friction and poor control of the tooling/work piece. The emulsification of this additional concentrate can also lead to the cutting fluid strength increasing to excessive levels.

iii) Use of oil skimmers/separators. These can vary in both price and performance. The simplest and cheapest types are either belt or disc skimmers that are immersed directly into machine sumps and pick up free oil from the surface of metalworking fluids. These are limited in their performance due to the fact that the oil will only separate from the fluid when there is no agitation (i.e. in 'dead' areas of the sump) or when the fluid is saturated with oil. At the other end of the scale are stand alone machines that extract fluid from machine sumps and remove any oil contamination. These can either be static, dedicated to a single machine, or mobile to service multiple machines on a rota basis. Although they are effective at removing the contamination from the fluids the cost of these units can be tens of thousands of pounds each. This can mean a significant capital investment even for moderately sized engineering shops.

iv) use of an anti-microbial agent in the cutting fluid, anti-nicrobials are dangerous chemicals, especially in concentrated form as an agent, and the anti-microbial needs to be added in correct dosages to maintain function.

PRIOR ART

The most effective way to prevent microbial growth in metalworking fluids has been the administration of an anti-microbial compound to the fluid. The addition of anti-microbials to fluids has been common place in both household and industrial environments.

Document-A—U.S. Pat. No. 4,968,323 discloses the use of a biocide composition or preservative in hydrocarbon fuels and metalworking fluids. The biocides are added to fuels such as home heating oil, diesel and jet fuels which are commonly stored in tanks where a layer of water can accumulate under the fuel. Also disclosed is the addition of bromopinacolone to emulsifiable oils to prevent growth of bacteria in metalworking fluids such as cutting and rolling fluids. Addition of the bromopinacolone, before contamination or after contamination of the metalworking fluid is disclosed.

Document-A—U.S. Pat. No. 4,414,121 discloses the addition of an anti-microbial agent to a water-based metal-working lubricant to prevent microbial growth therein.

Document-A—U.S. Pat. No. 5,508,417 discloses an broad-spectrum isothiazole anti-microbial agent which can be used in many situations to prevent microbial attack, generally this micro biocide is applied in a carrier such as water, a solvent or the like.

Document-A—U.S. Pat. No. 4,946,612 discloses a dual function oil composition for use both as a lubricating oil on sliding surfaces and as a metalworking fluid to solve the problem of having two different solutions which can mix to their detriment. A secondary property of this oil composition is bacterial or fungal resistance.

However, addition of anti microbial compositions into metalworking fluids can be problematic, most of the compositions used are toxic and comprise dangerous chemicals. The quantities of anti microbial compounds used in metalworking fluids must be carefully monitored so that firstly, the concentration of compound is high enough to have a sufficient anti microbial effect and secondly, that the concentration is not at a level high enough to cause damage to people working in the vicinity of machinery treated with it.

OBJECT OF THE INVENTION

It is an object of the invention to overcome the above-stated problem by introducing an anti-microbial agent to a metalworking fluid in a novel, safe and economic manner.

THE INVENTION

According to the present invention a method of preventing microbial growth in an oil-water emulsion metalworking fluid in a machine wherein lubricating oil or hydraulic or tapping fluid can contaminate the metalworking fluid, comprises adding an oil-water partitionable anti-microbial agent to the lubricating oil or hydraulic or tapping fluid whereby an effective quantity of the anti-microbial compound can partition into the metalworking fluid to reduce micro-organism activity. The lubricating oil or hydraulic or tapping fluid is used as a vehicle to deliver the anti-microbial agent into the metalworking fluid in a safe and effective manner. The agent can either be incorporated into the lubricating oil or hydraulic or tapping fluid or added to the lubricating oil or hydraulic or tapping fluid.

Also according to the present invention, a lubricating oil or hydraulic or tapping fluid composition for use in a machine, where an oil-water emulsion metalworking fluid is present, comprises a mineral oil base and an oil-water partitionable anti-microbial agent which will partition into the metalworking fluid and prevent micro-organism growth in the metalworking fluid particularly if the lubricating oil or hydraulic or tapping fluid seals the metalworking fluid to produce an anaerobic environment.

Further according to the method of the present invention, and wherein:

i) the machine has tooling to machine a work piece;

ii) the metalworking fluid is a cutting fluid;

iii) the machine tool has reservoir or sump to which cutting fluid drains and from which cutting fluid is delivered to the tooling and work piece the method further comprises the step of:

v) using migration of lubricating oil or hydraulic or tapping fluid into the cutting fluid sump as a vehicle to deliver effective quantities of the anti-microbial agent into the cutting fluid sump.

The machine tool may have a reservoir for lubricating oil or hydraulic or tapping fluid and the anti-microbial agent may be added to the lubricating oil or hydraulic or tapping fluid in the reservoir; or the anti-microbial agent may be incorporated as a composition with the lubricating oil or hydraulic or tapping fluid prior to use in the machine.

The machine tool may have a slideway and the lubricating oil may be a slideway lubricant.

An anti-microbial agent is herein defined "as any ingredient imparting microbial inhibiting properties".

Slideway lubricants are specialised products normally containing, in the lubricant base, agents for anti-wear, tackiness (to control excessive washout) and demulsification (to limit harmful effects of emulsifying the slideway lubricant into the cutting fluid).

The present invention thus uses a slideway lubricant that incorporates an anti-microbial agent which, when the lubricant is washed into a metalworking fluid, tramp oil, will transfer into the aqueous phase where it will maintain anti-microbial properties in the fluid. All of the primary functions of the slideway lubricant (lubrication, anti-wear, etc) are unaffected by the inclusion of the agent and no specialist equipment is required, the lubricant is used in the existing lubrication system on each machine.

This method of adding to the microbial resistance of the fluid is also 'intelligent' in that the more tramp oil collected in the cutting fluid sump, the more anti-microbial agent will be transferred into the fluid maximising its resistance. In cleaner systems where less tramp oil collects there is less requirement for high levels of extra anti-microbial agent.

EXAMPLE

The anti-microbial agent for inclusion in the hydraulic or tapping fluid or slideway lubricant can be any of the commercially available microbicides which has a good degree of solubility in both oil based and water based system that would be familiar to anyone in either the metalworking or biocide industries. Examples include formaldehyde releasing compounds such as triazine derivatives and oxazolidines, or non-formaldehyde products such as benzisothiazolinones and parachloro metacresol.

Factors in choosing the anti-microbial agent are:

i) Compatibility with the hydraulic or tapping fluid or slideway lubricant. The agent should not interfere with the primary function of the hydraulic or tapping fluid or slideway lubricant.

ii) Balanced oil and water solubility. The agent should be soluble in the slideway lubricant but also be sufficiently soluble in water to ensure that it is transferred into the metalworking fluid.

iii) Broad spectrum of anti-microbial activity. Metalworking fluids can be contaminated by bacteria and fungi both of which can have deleterious effects.

iv) Good toxicological profile. Metalworking fluids commonly come into contact with skin therefore the anti-microbial agent should pose as little hazard as possible.

Following these criteria, the preferred anti-microbial compound for the invention is 7a-ethyldihydro-1H,3H,5H-oxazolo(3,4-c)oxazole. This is commercially available from Angus Chemie under their trade name Bioban CS-1246. The properties of articular interest for this agent are:

i) No detrimental effect on the lubrication characteristics of the slideway lubricant. Experimental detail for specific examples is given later.

ii) Octanol/water partition co-efficient (log Pow) of 0.28. Indicating primarily oil solubility but with adequate water solubility to allow transfer of the anti-microbial into the water phase.

iii) Broad spectrum of anti-microbial activity indicated by the minimum inhibitory concentrations (MIC) for common spoilage organisms as follows:

| Organism | MIC (parts per million) |
|---|---|
| Bacterial: | |
| *Enterobacter aerogenes* | 250-300 |
| *Escherischia coli* | 450-500 |
| *Pseudomonas aeruginosa* | 800-850 |
| *Staphylococcus aureus* | 200-250 |
| Fungal: | |
| *Aspergillus niger* | 65-125 |
| *Fusarium moniliforme* | 125-250 |
| *Saccharomyces cerevisiae* | 16-33 |

iv) Low toxicity. As supplied the anti-microbial is harmful by inhalation and in contact with the skin, irritating to eyes and skin but is not a sensitising agent and is non-mutagenic. However at typical use dilutions there is no hazard with the product. This is indicated by its approval in Europe as a cosmetic preservative up to levels of 3000 parts per million.

The experimental details referred to above are:

Four samples consisting of a mineral oil base, a commercially available slideway lubricant agent package (containing agent agents for anti-wear, corrosion inhibition etc), a tackiness agent (to promote adhesion of the slideway lubricant to metal surfaces) and anti-bacterial agent (Bioban CS1246) were prepared as follows.

[Note: All compositions are % weight/weight.]

| | Sample A | Sample B | Sample C | Sample D |
|---|---|---|---|---|
| 500 Solvent neutral[1] | 60.45 | 62.95 | 66.45 | 67.95 |
| 150 Solvent neutral[2] | 36.30 | 32.80 | 28.30 | 25.80 |
| Hitec 510[3] | 2.25 | 2.25 | 2.25 | 2.25 |
| Hitec E151[4] | 1.00 | 1.00 | 1.00 | 1.00 |
| Bioban CS1246 | 0.00 | 1.00 | 2.00 | 3.00 |

[1]paraffinic mineral oil with a kinematic viscosity of approximately 100 cSt at 40° C.
[2]paraffinic mineral oil with a kinematic viscosity of approximately 30 cSt at 40° C.
[3]slideway lubricant agent package commercially available from Ethyl Petroleum Agents Ltd.
[4]polyisobutylene tackifier commercially available from Ethyl Petroleum Agents Ltd.

These samples were then subjected to an anti-bacterial screening test against Pseudomonas aeruginosa—one of the most common spoilage organisms found in cutting fluids.

The oil samples were placed in a 10 mm diameter "well" in the centre of an inoculated agar plate. The plates were then incubated for 48 hours and visually inspected. Any anti-bacterial activity of the samples is shown as a zone of inhibition—zero bacterial growth—around the original 10 mm diameter well, the diameter of which can be measured to give a semi-quantitative estimate of activity.

| Sample | Diameter of zero growth | Inhibited zone |
|---|---|---|
| A | 10 mm | 0 mm |
| B | 14 mm | 4 mm |
| C | 20 mm | 10 mm |
| D | 22 mm | 12 mm |

[Note: To obtain the measure of anti-bacterial activity the original diameter of the "well" must be subtracted (10 mm is therefore zero inhibition).]

From these results it is evident that the most cost effective balance between biocide level and activity was reached with sample C.

One of the key criteria in selecting an anti-microbial is to ensure compatibility with the slideway lubricant. Two of the key measures of this are the anti-wear and demulsification properties of the oil. Sample A (untreated slideway lubricant) and Sample C were tested using industry standard test methods as follows:

Demulsification test (40 mls of oil and 40 mls of water are mixed together in 100 ml measuring cylinder. At 5 minute intervals the volume of water separated from the oil/water mix is recorded).

| Time (minutes) | Sample A | Sample C |
|---|---|---|
| | Volume of $H_2O$ separated from oil/water mix (mls) | |
| 0 | 0 | 0 |
| 5 | 3 | 7 |
| 10 | 15 | 8 |
| 15 | 16 | 9 |
| 20 | 17 | 10 |
| 25 | 20 | 15 |
| 30 | 30 | 15 |
| 35 | 36 | 18 |
| 40 | 37 | 24 |
| 45 | 37 | 29 |
| 50 | 38 | 31 |
| 55 | 38 | 32 |
| 60 | 39 | 34 |

Although the rate of separation of water is slowed by the inclusion of the anti-microbial, demulsification does still occur. In practice the slightly slower rate of separation should provide a longer time scale for the transfer of the anti-microbial into the cutting fluid.

The shell 4 ball wear test was carried out to determine the two lubricants ability to prevent wear.

Shell 4-ball ear test (60 kg load run for 15 minutes) Sample A

| Ball number | Wear scar dimensions mm |
|---|---|
| 1 | 0.709 × 0.723 |
| 2 | 0.728 × 0.709 |
| 3 | 0.708 × 0.725 |

Mean scar diameter = 0.717 mm

Sample C

| Ball number | Wear scar dimensions mm |
|---|---|
| 1 | 0.479 × 0.457 |
| 2 | 0.463 × 0.444 |
| 3 | 0.470 × 0.451 |

Mean scar diameter = 0.462 mm

It can be seen that anti-wear properties are improved by the inclusion of an anti-microbial agent, despite the overall composition containing less paraffinic mineral oil. The improvement is unexpected and, while not fully explained, may be due to catalysation of chemical reaction between the sulphur and phosphorus anti-wear agent agents present in the oil and the steel surface.

The invention claimed is:

1. A slideway lubricant composition for metal-working machinery utilizing metalworking fluids, comprising a slideway lubricating oil, having a paraffinic mineral oil, an anti-wear agent, a polyisobutylene tackifier, a corrosion inhibitor, and a demulsification agent in combination with 7a-ethyldihydro-1H,3H,5H-oxazolo(3,4-c)oxazole as an oil-water partitionable anti-microbial agent compatible with and soluble in said slideway lubricating oil and of sufficient solubility in water for transference into a metalworking fluid.

* * * * *